US006070492A

United States Patent [19]

Beil

[11] Patent Number: 6,070,492

[45] Date of Patent: Jun. 6, 2000

[54] PEDAL FOR A MOTOR VEHICLE

[75] Inventor: Egon Beil, Florstadt, Germany

[73] Assignee: Mannesmann VDO AG, Frankfurt, Germany

[21] Appl. No.: 09/148,549

[22] Filed: Aug. 26, 1998

[30] Foreign Application Priority Data

Aug. 27, 1997 [DE] Germany ..... 197 37 287

[51] Int. Cl.[7] ..... G05G 1/14

[52] U.S. Cl. ..... 74/560; 74/512; 74/482

[58] Field of Search ..... 74/512, 513, 560, 74/561, 562, 562.5, 564, 563

[56] References Cited

U.S. PATENT DOCUMENTS

| | | | |
|---|---|---|---|
| 2,507,009 | 5/1950 | Haushalter et al. | 74/513 |
| 2,914,961 | 12/1959 | Ewer | 74/562.5 |
| 3,275,094 | 9/1966 | Kennedy | 74/564 |
| 3,715,934 | 2/1973 | Reed | 74/560 |
| 4,356,740 | 11/1982 | Kubo et al. | 74/560 |
| 4,899,614 | 2/1990 | Kataumi | 74/560 |
| 5,186,076 | 2/1993 | Kataumi et al. | 74/560 |
| 5,398,570 | 3/1995 | Chae | 74/560 |
| 5,690,000 | 11/1997 | Terrel | 74/560 |

FOREIGN PATENT DOCUMENTS

| | | | |
|---|---|---|---|
| 2240480 | 3/1975 | France | 74/560 |
| 3182916 | 8/1991 | Japan | 74/560 |

*Primary Examiner*—David A. Bucci
*Assistant Examiner*—Chong H. Kim
*Attorney, Agent, or Firm*—Martin A. Farber

[57] ABSTRACT

A pedal (1) for a motor vehicle, comprising a pedal plate (4) fastened on a u-shaped retaining region (9) of a pedal bar (2) by means of an eyelet (7) and a clip (8). The u-shaped retaining region (9) extends directly along a frame web (5) on the border of the pedal plate (4), this minimizing to the greatest possible extent tilting movements which could result in the pedal plate (4) being released from the pedal bar (2).

8 Claims, 2 Drawing Sheets

PEDAL FOR A MOTOR VEHICLE

FIELD AND BACKGROUND OF THE INVENTION

The invention relates to a pedal for a motor vehicle, in particular a gas pedal, which has a pedal bar which is retained pivotably in a pedal support at one end and at the free end of which a pedal plate is fastened by means of at least one clip.

It is usually the case that a pedal plate, on which a cap made of rubber or plastic is positioned in a releasable manner, is welded to pedal bars of motor-vehicle pedals. The production of such a welded pedal is comparatively expensive because the pedal bars are configured individually for different types of motor vehicle. The problem arises particularly in the case of gas-pedal modules which are used as setpoint generators, in the case of which a vehicle-specific pedal bar is connected to a standardized setpoint-generator module. The large number of bar forms means that a dedicated retaining device is required in each case for welding pedal plates thereon.

It has also already been proposed to produce a unit, comprising pedal bar and pedal plate, in one piece from plastic using injection molding. This requires relatively high-outlay type-specific molds which can each be used only for the pedals of a certain type of motor vehicle, with the result that such pedals are also expensive to produce.

In practice, a pedal with a pedal plate clipped onto the free end of the pedal bar has also already been disclosed. The configuration of this pedal, however, is such that the pedal plate projects downward beyond the pedal bar. This means that there is a risk, when the lowermost region of the pedal plate is pressed down, of the resulting tilting movement leading to the clip connection being released.

SUMMARY OF THE INVENTION

An object of the invention is to provide a pedal of the type mentioned in the introduction such that its pedal plate is retained on the pedal bar as reliably as possible, by a clip connection, against release, even in the case of high actuating forces, without the pedal, for this purpose, having to involve high outlay in terms of configuration and assembly.

According to the invention, in a plane parallel to the plane of the pedal plate, the pedal-plate end of the pedal bar has a U-shaped retaining region which comprises two legs, extending in the region of the lateral borders of the pedal plate, and a base which connects said legs and extends in the region of the lowermost border of the pedal plate, in that the leg which has a free end engages in a closed eyelet on the rear side or underside of the pedal plate, and in that the retaining bar is latched, at a distance from the axis of the eyelet, into a clip which is likewise provided on the rear side of the pedal plate.

With such a pedal, the pedal plate is supported on its two sides and on its underside, in each case in the immediate vicinity of its outer border, by the retaining region of the pedal bar. The rest surface for the pedal plate on the free end of the pedal bar is thus brought as close as possible to that border of the pedal plate which is remote from the pivot axis of the pedal. Rather than just being supported in the main direction of the pedal bar, the pedal plate is thus also supported transversely thereto, over as wide an area as possible. This means that, when the pedal is actuated, there are no movements which could result in the pedal plate being released from the pedal bar. Fixing the pedal plate by means of an eyelet and a clip is likewise very reliable since, for the purpose of releasing the pedal plate, first of all pivoting about the axis of the eyelet and then displacement in the main direction in which the pedal bar extends are necessary. This configuration rules out the possibility of unintentional contact of the foot with the pedal from the rear side or underside of the pedal plate being able to release the pedal plate from the pedal bar.

The pedal plate is a very stable design, despite the small amount of material used, and is retained on the pedal bar particularly reliably against the occurrence of tilting movements relative to the pedal bar if according to one advantageous feature of the invention, on its rear side, it has a peripheral frame web which protrudes toward the rear side, forms the border of the pedal plate and on the underside of the pedal plate, flush with the eyelet, it has a recess which is open toward the rear side and is intended for receiving a leg of the pedal bar frame when is pushed into the eyelet.

The clip into which the pedal plate latches, once the free bar end has first of all been pushed into the closed eyelet and has then been pivoted about the eyelet, may be arranged in a region where it does not have to protrude beyond the lateral contours of the pedal plate if, on the top side of the pedal plate, the pedal bar runs approximately on the axis of symmetry of the pedal plate, if, behind the pedal plate, the pedal bar first of all has an angled section which is directed toward the border of the pedal plate and which is adjoined by the u-shaped retaining region, and if the clip is provided in the region of the angled section. The angled section also makes it possible for the pedal plate to be supported centrally in the top region by the pedal bar, while in the lower region, where there is a more likely risk of the foot introducing lateral forces, the u-shaped retaining region supports the pedal plate on both sides. Since the axis of the clip runs at an angle to the axis of the eyelet, it is not possible either for the pedal plate to be pulled off or to slide off the retaining region.

The frame web can additionally contribute to increasing the retaining forces of the pedal plate on the retaining region if the u-shaped retaining region rests against the frame web.

The retaining plate may be made up in two parts from a cost-effective plastic part and a reinforcing metal part, for the purpose of achieving sufficient strength against high actuating forces (in the case of brake or clutch pedals), if the pedal plate has a reinforcement plate on its rear side, and if the eyelet and clip project through in each case one through-passage in said reinforcement plate.

The two-part pedal plate can be produced particularly cost-effectively if, according to another feature of the invention, the reinforcement plate is retained in the pedal plate by a clip connection.

The pedal bar is optimally shaped for actuation by the foot if, between the pedal support and the pedal plate, it has a bent or angled region which protrudes in the direction of actuation.

The stable design and securing of the clipped pedal plate means that such pedals can be used not just as gas pedals, but also as clutch or brake pedals.

BRIEF DESCRIPTION OF THE DRAWINGS

With the above and other objects and other advantages in view, the present invention will become more clearly understood in connection with the detailed description of a preferred embodiment, when considered with the accompanying drawings of which.

DETAILED DESCRIPTION OF THE PREFERRED EMBODIMENT

Figure 1:
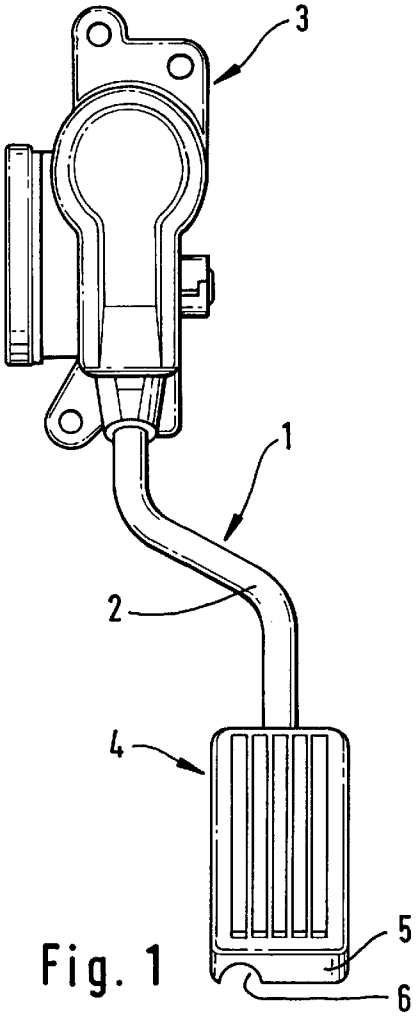
FIG. 1 shows a front view of a pedal according to the invention.

FIG. 1 shows, in its entirety, a pedal 1 which has a cross-sectionally round pedal bar 2 mounted by one end in a pedal support 3. In this case, said pedal support is designed as a standardized setpoint-generator module which, in a known manner, comprises the pedal pivot mounting, restoring and damping means, electric signal transmitters (displacement or angle pickups) and the connections required for transmitting the electric position signals generated.

The free ends of the pedal bar 2, which is formed in a vehicle-specific manner, bears a pedal plate 4. On its outer border, the latter has a peripheral frame web 5 which, on the side which is oriented downward—away from the pedal support—and which is the only side which can be seen in FIG. 1, has a recess 6 which is open toward the rear side or underside of the pedal 1 and of which the function will be explained below. The pedal plate 4 is retained on the pedal bar 2 by a clip connection.

Figure 2:
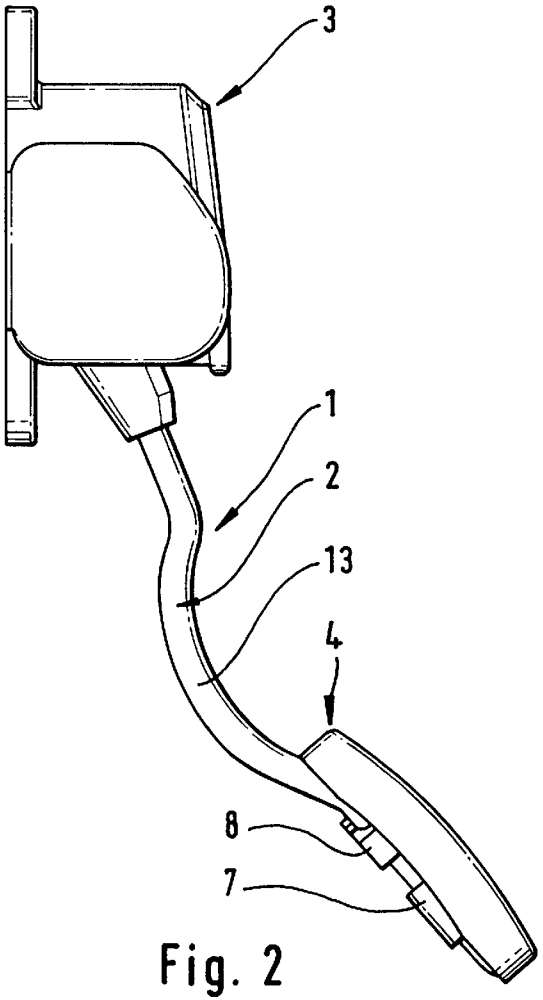
FIG. 2 shows a side view of the pedal.

FIG. 2 shows an eyelet 7 and a clip 8, each protruding toward the rear side of the pedal plate 4. The pedal bar 2 engages, by way of its free end, in a bore of said eyelet 7 and is additionally latched in the clip 8 which, for this purpose, has two resilient arms partially engaging over the pedal bar 2. Between the pedal support 3 and the pedal plate 4, the pedal bar 2 has a region 13 which is bent in the direction of actuation.

Figure 3:
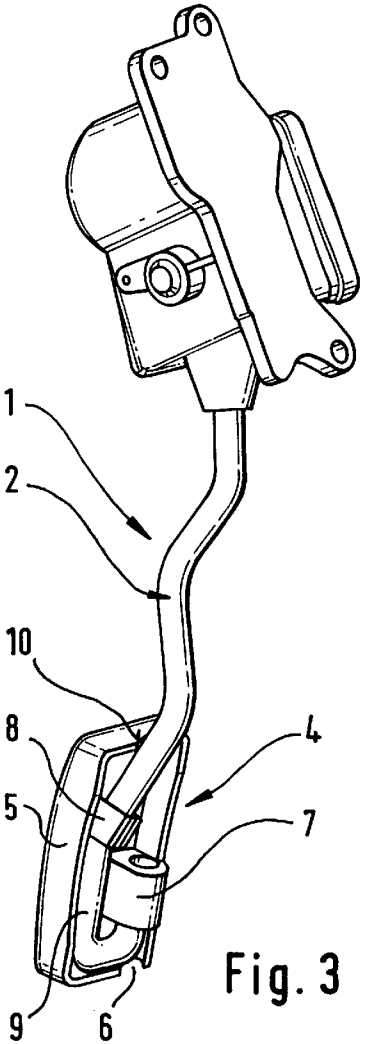
FIG. 3 shows a perspective view of the pedal, as seen obliquely from the rear.

It can be seen from the perspective illustration according to FIG. 3 that, at its free end, the pedal bar 2 has a u-shaped retaining region 9, of which the free end leads into the eyelet 7 and over which the clip 8 engages further up. FIG. 3 also shows the recess 6 in the frame web 5. It is also possible for a corresponding recess 10 to be provided in the top side of the frame web 5, in order for it to be possible for the pedal bar 2 to be guided upward without an angled section leading beyond the frame web 5.

Figure 4:
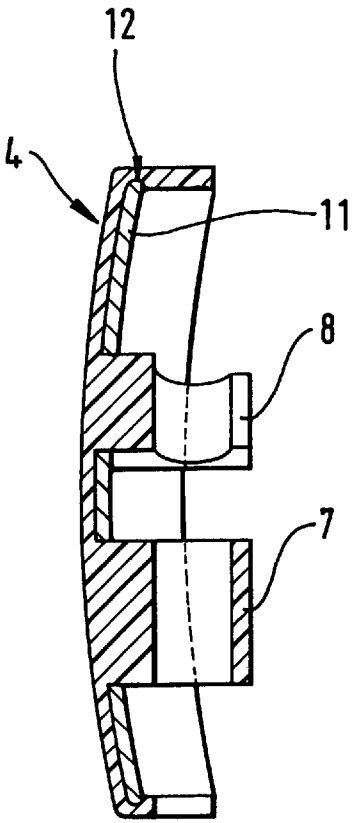
FIG. 4 shows a cross section through an embodiment of the pedal plate for the pedal.

The pedal plate 4 shown in FIG. 4 has, on its rear side, a reinforcement plate 11 which is retained in the pedal plate 4 by a latching connection 12 and has through-passages (not indicated) through which the eyelet 7 and the clip 8 project.

Figure 5:
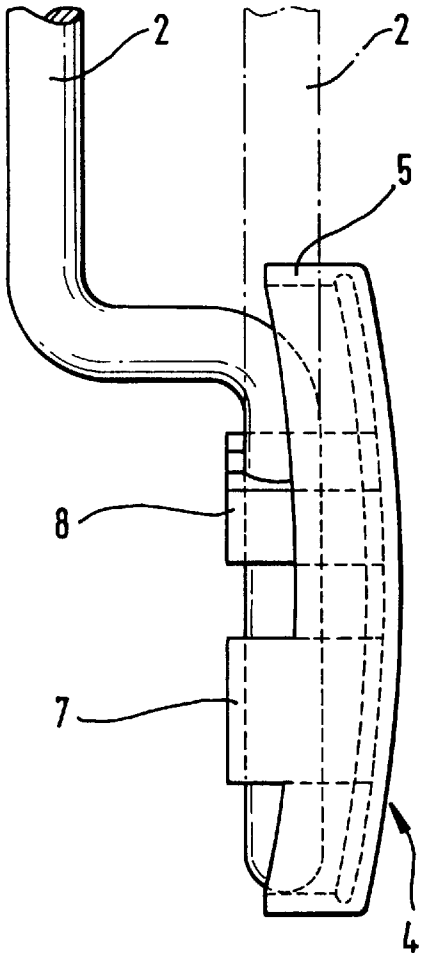
FIG. 5 shows a side view of a bottom region of the pedal.

FIG. 5 illustrates the configuration of the pedal 1 in the region of the pedal plate 4. It can be seen that, before reaching the frame web 5, the pedal bar 2 bends away from the pedal plate 4, with the result that the pedal bar 2 does not have to be guided through the frame web 5. However, it is also possible for the pedal bar 2 to be rectilinear (indicated by chain-dotted lines) or to be curved to a lesser extent in this region.

Figure 6:
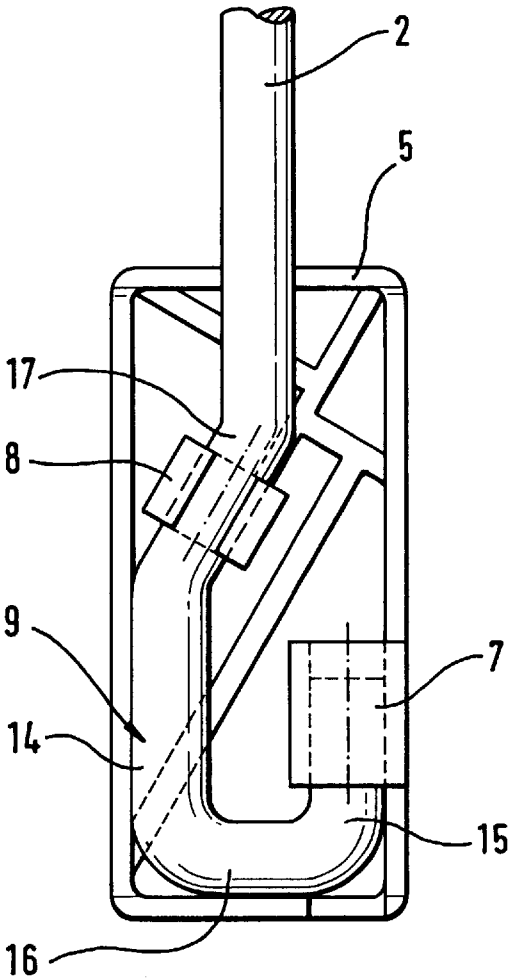
FIG. 6 shows a rear view of the bottom pedal region shown in FIG. 5.

FIG. 6 shows that the axis of the clip 8 is set at an angle to the axis of the eyelet 7 by the angulation 17 of the pedal bar 2, and that the u-shaped retaining region 9 of the pedal bar 2 is formed from two lateral legs 14, 15 and a base 16. The leg 15 engages in the eyelet 7 and extends in the immediate vicinity of the frame web 5, as do the base 16 and the leg 14. When the pedal plate is pushed parallel to the plane of the u-shaped retaining region 9, it is not only the case that the frame web 5 prevents the pedal plate from sliding off, but the latter is also secured in its position by virtue of the clip wedging against the eyelet.

I claim:

1. A pedal for a motor vehicle, comprising:

a pedal support;

a pedal plate having a rear side with a closed eyelet and a clip, and said pedal plate having lateral border regions and another border region, said another border region being oriented away from the pedal support;

a pedal bar having one end pivotably retained in said pedal support and a free end fastened to the pedal plate;

in a plane parallel to a plane of the pedal plate, said free end of the pedal bar has a retaining region which comprises two parallel legs extending in said lateral border regions of the pedal plate, and a base connecting said legs and extending in said another border region of the pedal plate;

wherein one of said legs forms the free end of the pedal bar and extends into said closed eyelet on the rear side of the pedal plate; and wherein said clip on the rear side of said pedal plate is located spaced from an axis of the eyelet, and said pedal bar is latched onto said clip; and wherein the pedal plate further comprises a peripheral frame web which projects at said rear side of the pedal plate and forms an outer border of the pedal plate, and at said rear side of the pedal plate, flush with said eyelet, said frame web has a recess open at said rear side and adapted for receiving said one of said legs for being pushed into the eyelet during fastening of said pedal bar to said pedal plate; and wherein, at said rear side of the pedal plate and at a top region of the pedal plate, said pedal bar extends approximately centrally with respect to the pedal plate, and said pedal bar has an angled section thereof which is directed toward one of said lateral borders of the pedal plate, said pedal bar extending from said angled section into said retaining region, said retaining region being U-shaped.

2. The pedal according to claim 1, wherein, said clip is located in a region of the pedal plate adjacent the angled section.

3. The pedal according to claim 1, wherein said retaining region of the pedal bar is U-shaped and said U-shaped retaining region rests against said frame web of the pedal plate.

4. The pedal according to claim 1, further comprising a reinforcement plate on the rear side of the pedal plate, said reinforcement plate is formed with openings therethrough and said eyelet and said clip project through respective of said openings in the reinforcement plate.

5. The pedal according to claim 4, wherein the reinforcement plate is retained in the pedal plate by a clip connection.

6. The pedal according to claim 1, wherein said pedal bar has a bent region between said pedal support and said pedal plate, said bent region protrudes in a direction towards an actuator.

7. The pedal according to claim 1, wherein the pedal is a gas pedal.

8. The pedal according to claim 1, wherein the clip has an axis which extends at an angle with respect to the axis of the eyelet, so as to prevent the pedal plate from sliding off the retaining region of the pedal bar.

* * * * *